US007267917B2

(12) United States Patent
Tong et al.

(10) Patent No.: US 7,267,917 B2
(45) **Date of Patent: *Sep. 11, 2007**

(54) PHOTORECEPTOR CHARGE TRANSPORT LAYER COMPOSITION

(75) Inventors: Yuhua Tong, Webster, NY (US); Kenny-Tuan T. Dinh, Webster, NY (US); Markus R. Silvestri, Fairport, NY (US); Michael E. Zak, Canandaigue, NY (US); John F. Yanus, Webster, NY (US); Min-Hong Fu, Webster, NY (US); David M. Skinner, Rochester, NY (US); Kathleen M. Carmichael, Williamson, NY (US); Colleen A. Helbig, Penfield, NY (US); Dale S. Renfer, Webster, NY (US); John A. Bergfjord, Sr., Macedon, NY (US); Susan M. Van Dusen, Williamson, NY (US); Anthony M. Horgan, Pittsford, NY (US); Jin Wu, Webster, NY (US); Steven M. Sterling, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 437 days.

This patent is subject to a terminal disclaimer.

(21) Appl. No.: 10/944,914

(22) Filed: Sep. 21, 2004

(65) Prior Publication Data

US 2006/0063080 A1 Mar. 23, 2006

(51) Int. Cl.
*G03G 5/047* (2006.01)

(52) U.S. Cl. ..... 430/72; 430/73; 430/69; 430/58.65; 430/96; 399/159

(58) Field of Classification Search ..... 430/72, 430/73, 69, 58.65, 96; 399/159
See application file for complete search history.

(56) References Cited

U.S. PATENT DOCUMENTS

| | | | | |
|---|---|---|---|---|
| 4,047,948 | A | 9/1977 | Horgan | |
| 4,265,990 | A | 5/1981 | Stolka et al. | |
| 4,346,158 | A | 8/1982 | Pai et al. | |
| 4,388,392 | A | 6/1983 | Kato et al. | |
| 4,801,517 | A | 1/1989 | Frechet et al. | |
| 4,806,443 | A | 2/1989 | Yanus et al. | |
| 4,818,650 | A | 4/1989 | Limburg et al. | |
| 4,959,288 | A | 9/1990 | Ong et al. | |
| 5,069,991 | A * | 12/1991 | Leyrer et al. | 430/49 |
| 5,122,429 | A | 6/1992 | Sundararajan et al. | |
| 5,202,408 | A | 4/1993 | Yanus et al. | |
| 5,262,512 | A | 11/1993 | Yanus et al. | |
| 5,681,678 | A | 10/1997 | Nealey et al. | |
| 6,194,111 | B1 | 2/2001 | Fuller et al. | |
| 6,645,686 | B1 | 11/2003 | Fu et al. | |
| 7,045,262 | B2 * | 5/2006 | Tong et al. | 430/58.05 |
| 2005/0164104 | A1 * | 7/2005 | Tong et al. | 430/58.05 |

FOREIGN PATENT DOCUMENTS

| | | |
|---|---|---|
| EP | 0 034 425 A2 | 8/1981 |

OTHER PUBLICATIONS

U.S. Appl. No. 10/889,054, filed Jul. 13, 2004, Tong et al.

* cited by examiner

*Primary Examiner*—Mark A. Chapman
(74) *Attorney, Agent, or Firm*—Oliff & Berridge, PLC.

(57) ABSTRACT

A charge transport layer composition for a photoreceptor includes at least a binder, at least one arylamine charge transport material, e.g., N,N'-diphenyl-N,N'-bis(3-methylphenyl)-(1,1'-biphenyl)-4,4'-diamine, and at least one polymer containing carboxylic acid groups or groups capable of forming carboxylic acid groups. The charge transport layer forms a layer of photoreceptor, which also includes an optional anti-curl layer, a substrate, an optional hole blocking layer, an optional adhesive layer, a charge generating layer, and optionally one or more overcoat or protective layers.

20 Claims, No Drawings

PHOTORECEPTOR CHARGE TRANSPORT LAYER COMPOSITION

BACKGROUND OF THE INVENTION

1. Field of Invention

This invention relates to a novel composition for a charge transport layer of a photoreceptor used in electrophotographic devices such as photocopiers. More in particular, the invention relates to a particular composition for a charge transport layer that includes a binder and one or more arylamine charge transporting molecules, along with at least one polymer containing carboxylic acid groups or groups capable of forming carboxylic acid groups, and optional anti-oxidants.

2. Description of Related Art

In the art of electrophotography, an electrophotographic imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper. This imaging process may be repeated many times with reusable photosensitive members.

Electrophotographic imaging members are usually multilayered photoreceptors that comprise a substrate support, an electrically conductive layer, an optional hole blocking layer, an optional adhesive layer, a charge generating layer, a charge transport layer, and optional protective or overcoating layer(s). The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness.

Typical electrophotographic imaging members (for example, photoreceptors) comprise a photoconductive layer comprising a single layer or composite layers. One type of composite photoconductive layer used in xerography is illustrated, for example, in U.S. Pat. No. 4,265,990, which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photogenerating layer is sandwiched between the contiguous charge transport layer and the supporting conductive layer, and the outer surface of the charge transport layer is normally charged with a uniform electrostatic charge.

As more advanced, complex, highly sophisticated, electrophotographic copiers, duplicators and printers are developed, greater demands are placed on the photoreceptor to meet stringent requirements for the production of high quality images.

One type of multi-layered photoreceptor that has been employed as a belt in electrophotographic imaging systems comprises a substrate, a conductive layer, a charge blocking layer, a charge generating layer, and a charge transport layer. The charge transport layer often comprises an activating small molecule dispersed or dissolved in a polymeric film forming binder. Generally, the polymeric film forming binder in the transport layer is electrically inactive by itself and becomes electrically active when it contains the activating molecule. The expression "electrically active" means that the material is capable of supporting the injection of photogenerated charge carriers from the material in the charge generating layer and is capable of allowing the transport of these charge carriers through the electrically active layer in order to discharge a surface charge on the active layer. The multi-layered type of photoreceptor may also comprise additional layers such as an anti-curl backing layer, required when layers possess different coefficient of thermal expansion values, an adhesive layer, and an overcoating layer. Commercial high quality photoreceptors have been produced which utilize an anti-curl coating.

Photoreceptors have been developed which comprise charge transfer complexes prepared with polymeric molecules. For example, charge transport complexes formed with polyvinyl carbazole are disclosed in U.S. Pat. Nos. 4,047,948, 4,346,158 and 4,388,392. Photoreceptors utilizing polyvinyl carbazole layers, as compared with current photoreceptor requirements, exhibit relatively poor xerographic performance in both electrical and mechanical properties. Polymeric arylamine molecules prepared from the condensation of di-secondary amine with a di-iodo aryl compound are disclosed in European Patent Publication No. 34,425, published Aug. 26, 1981. Since these polymers are extremely brittle and form films which are very susceptible to physical damage, their use in a flexible belt configuration is precluded.

Photoreceptors having charge transport layers containing charge transporting arylamine polymers have been described in the patent literature, for example in U.S. Pat. Nos. 4,806,443, 4,801,517, 4,818,650, 4,959,288, 5,202,408 and 5,262,512, the entire disclosures of these patents being incorporated herein by reference. These polymers tend to possess poor mechanical properties and are soft and non-robust.

Other photoreceptors having charge transport layers containing a charge transport molecule and a binder mixture comprising a polycarbonate and an elastomeric block copolymer have been described in U.S. Pat. No. 5,122,429.

U.S. Pat. No. 6,645,686 describes an electrophotographic imaging member having a charge transport layer that is comprised of a binder and charge transport molecules, wherein the binder eliminates or minimizes crystallization of the charge transport molecules. Specific binders are polycarbonate binders such as PCZ-800, PCZ-500, and PCZ-400 polycarbonate resin.

U.S. Pat. No. 6,194,111 describes a crosslinkable charge transport layer material for a photoconductor that includes at least one poly(arylene ether alcohol), at least one polyisocyanate crosslinking agent and at least one charge transport material dispersed in a solvent. The crosslinkable charge transport layer material is crosslinked following application of the coating solution to the photoconductor. The photoconductor including such crosslinked charge transport layer exhibits excellent wear resistance so as to have long life, thereby reducing the cost of electrophotographic printing machines employing such photoconductors therein.

One of the most noticeable problems still present in current organic photoreceptors is lateral charge migration (LCM). It appears that a primary cause of LCM is the increased conductivity of the photoreceptor surface, which results in charge spreading of the latent electrostatic image, which image in turn is subsequently developed less precisely by toner.

There continues to be a need for improved electrophotographic imaging members, particularly imaging members that are able to achieve high quality images, capable of rapid and repeated charging and discharging and exhibiting substantially no lateral charge migration.

SUMMARY OF THE INVENTION

In a first embodiment, the present invention relates to a charge transport layer composition for a photoreceptor, comprising at least a binder, at least one arylamine charge transport material, and at least one polymer containing carboxylic acid groups or groups capable of forming carboxylic acid groups.

In a further embodiment, the present invention relates to an image forming device comprising at least a photoreceptor and a charging device which charges the photoreceptor, wherein the photoreceptor comprises an optional anti-curl layer, a substrate, an optional hole blocking layer, an optional adhesive layer, a charge generating layer, a charge transport layer comprising at least a binder, at least one arylamine charge transport material, and a polymer containing carboxylic acid groups or groups capable of forming carboxylic acid groups, and optionally one or more overcoat or protective layers.

In a still further embodiment, the present invention relates to an electrophotographic device that contains the image forming device of the invention.

The charge transport layer of the present invention exhibits substantially no lateral charge migration, exhibits good resistance to solvent vapors and corona effluents, and exhibits good cyclic stability (substantially no cycle-up problems). The charge transport layer of the invention thus enables production of photoreceptors capable of achieving high quality reprographic images over its period of use.

DETAILED DESCRIPTION OF PREFERRED EMBODIMENTS

The charge transport layer composition of the invention must include at least a binder, at least one arylamine charge transport material, and at least one polymer containing carboxylic acid groups or groups capable of forming carboxylic acid groups. Each of these required components of the composition is discussed below.

The binder should eliminate or minimize crystallization of the charge transport material and should be soluble in a solvent selected for use with the composition such as, for example, methylene chloride, chlorobenzene, tetrahydrofuran, toluene or another suitable solvent. Suitable binders may include, for example, polycarbonates, polyesters, polyarylates, polyacrylates; polyethers, polysulfones and mixtures thereof. For the preferred solvent of methylene chloride and the preferred charge transport materials, the binder is preferably a polycarbonate. Although any polycarbonate binder may be used, preferably the polycarbonate is either a bisphenol Z polycarbonate or a biphenyl A polycarbonate. Example biphenyl A polycarbonates are the MAKROLON® polycarbonates. Example bisphenol Z polycarbonates are the LUPILON® polycarbonates, also widely identified in the art as PCZ polycarbonates, e.g., PCZ-800, PCZ-500 and PCZ-400 polycarbonate resins and mixtures thereof.

As the charge transport materials, at least one of the charge transport materials must comprise an arylamine compound. Arylamine charge transport materials can be subdivided into monoamines, diamines, triamines, etc.

A generic aryl monoamine is illustrated in formula 1.

Formula 1:

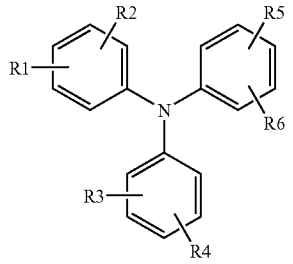

where R1, R2, R3, R4, R5 and R6 can be selected independently from aryl, H, methyl, ethyl, propyl and butyl groups. For example, in DBA (N,N'-di-(3,4-dimethylphenyl)-4-biphenylamine), R1=R2=R3=R4=methyl, R5 H, and R6=4-phenyl. See formula 2.

Formula 2:

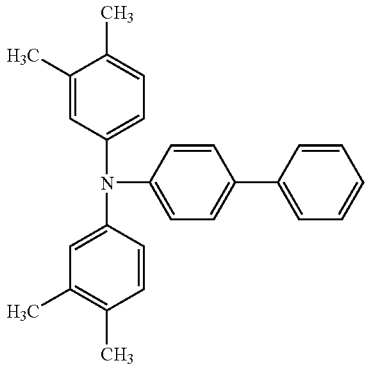

DBA

Examples of aryl monoamines include: bis-(4-methylphenyl)-4-biphenylylamine, bis(4-methoxyphenyl)-4-biphenylylamine, bis-(3-methylphenyl)-4-biphenylylamine, bis(3-methoxyphenyl)-4-biphenylylamine-N-phenyl-N-(4-biphenylyl)-p-toluidine, N-phenyl-N-(4-biphenylyl)-p-toluidine, N-phenyl-N-(4-biphenylyl)-m-anisidine, bis(3-phenyl)-4-biphenylylamine, N,N,N-tri[3-methylphenyl]amine, N,N,N-tri[4-methylphenyl]amine, N,N-di(3-methylphenyl)-p-toluidine, N,N-di(4-methylphenyl)-m-toluidine, bis-N,N-[(4'-methyl-4-(1,1'-biphenyl)]-aniline, bis-N,N-[(2'-methyl-4(1,1'-biphenyl)]-aniline, bis-N,N-[(2'-methyl-4(1,1'-biphenyl)]-p-toluidine, bis-N,N-[(2'-methyl-4(1,1'-biphenyl)]-m-toluidine, and N,N-di-(3,4-dimethylphenyl)-4-biphenylamine (DBA), and mixtures thereof.

A generic aryl diamine is illustrated in formula 3:

Formula 3

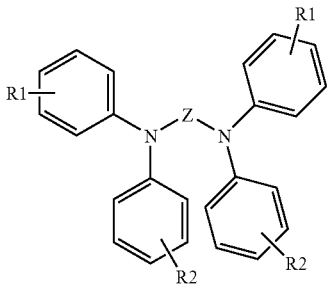

where R1 and R2 are selected independently from methyl, ethyl, propyl and aryl. Z is selected from the group consisting of

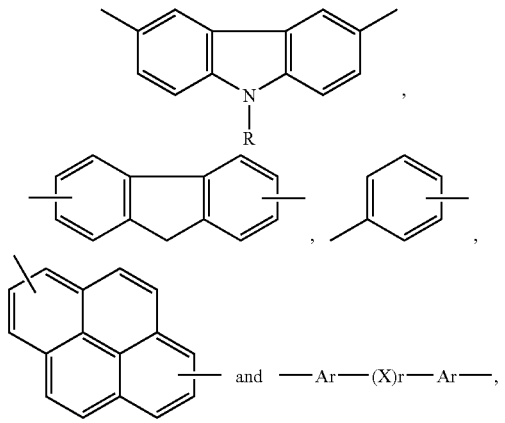

r is 0 or 1,

Ar is selected from the group consisting of:

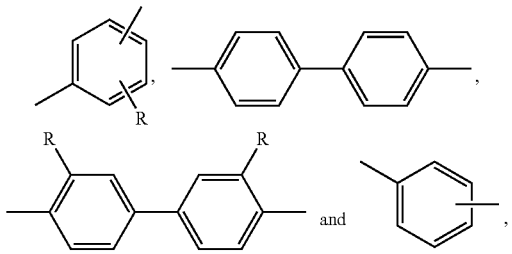

R is selected from the group consisting of methyl, ethyl, propyl and butyl, and X is selected from the group consisting of:

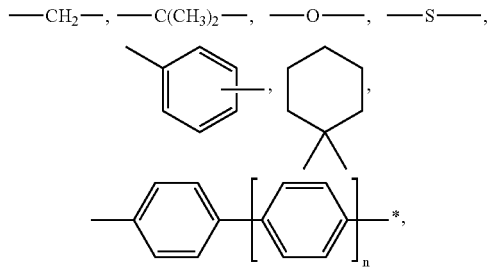

n being any suitable integer.

The charge transport compounds of the invention also include aryl diamines as described in U.S. Pat. Nos. 4,306,008, 4,304,829, 4,233,384, 4,115,116, 4,299,897, 4,265,990, 4,081,274 and 6,214,514, each incorporated herein by reference. Typical aryl diamine transport compounds include N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3-methylphenyl)-[1,1'-biphenyl]-4,4'-diamine (TPD—see formula 4 below), N,N'-diphenyl-N,N'-bis(3-hydroxyphenyl)-(1,1'-biphenyl)-4,4'-diamine (DHTPD—see formula 5 below), N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, mixtures thereof and the like.

Formula 4

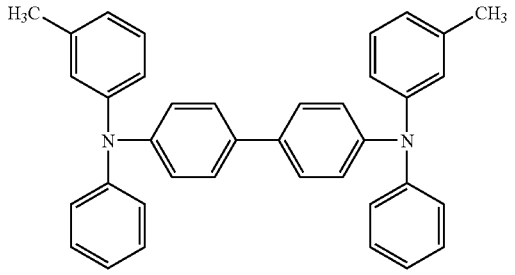

TPD

Formula 5

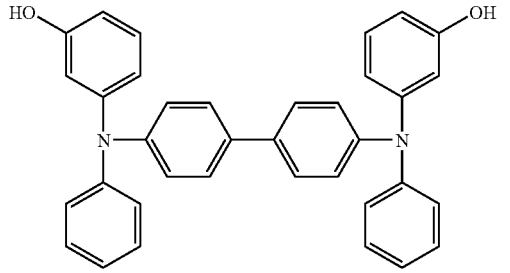

DHTPD

However, the use of arylamine charge transport materials is not without problems. In particular, aryl diamines (formula 3) are believed to complex with nitrous oxide effluents, e.g., from bias charging rolls and corona charging devices. The oxidative complex of the aryl diamine charge transport materials with nitrous oxides results in increased conductivity at the surface of the photoreceptor, thereby causing lateral charge migration (LCM) and ultimately poor image reproduction. In electrophotographic devices utilizing multiple corotron charging devices around the photoreceptor, this problem can be magnified. Conversely, with nitrous oxides, aryl monoamines (formula 1) generally react, without forming persistent intermediate species, to rapidly form nitrated aryl monoamines.

The use of a bisphenol Z polycarbonate (PCZ) binder allows the reduction of lateral charge migration, because PCZ shields the charge transport materials from nitrous oxides. The bisphenol Z polycarbonates exhibit the most resistance, and thus are most preferred for minimizing LCM. However, the use of a binder resistant to nitrous oxide intrusion alone does not appear to sufficiently reduce the conductivity of aryl diamine/nitrous oxide complex.

In embodiments of the present invention, it has been found that the charge transport materials may be or include N,N-di-(3,4-dimethylphenyl)-4-biphenylamine(biphenyl-4-yl-bis-(3,4-dimethyl-phenyl)-amine) (hereinafter DBA) (formula 2). DBA has been found not to form long-lived conductive species with nitrous oxides, and thus its use can reduce the lateral charge migration problem associated with aryl diamine charge transport agents such as TPD and DHTPD.

Thus, while in certain applications it may be appropriate to use only aryl diamines such as TPD (formula 4), DHTPD (formula 5), combinations, etc. depending on the desired properties, it may also be preferable to include additional charge transport materials to the composition, including monoamines such as DBA, etc. For example, the composition of the charge transport layer may include both an aryl diamine and an aryl monoamine as the charge transport material. In this embodiment, the ratio of aryl diamine(s) to the aryl monoamine(s) is preferably from about 90:10 to 10:90. Of course, additional non-arylamine charge transport materials may also be included in the composition, if desired or required.

The charge transport materials of the present invention may still suffer from poor cyclic stability. That is, the charge transport materials may tend to exhibit higher residual voltages (Vr), and have a serious cycle-up problem with repeated electrical cycling. Further, in a large scale manufacturing processes, impurities are sometimes found in charge transport materials. These impurities can be expensive to remove and may cause disruption in the chain of supplies. In most cases, these impurities cause the residual voltage to increase dramatically. Further, highly purified aryl monoamines exhibit a higher residual voltages due to lower (slower) hole mobility at low fields. Other charge transport materials like DHTPD possess low mobility at high and low field conditions. To address these potential problems, it is necessary to include in the charge transport layer composition a polymer containing carboxylic acid groups, or groups capable of forming carboxylic acid groups, that acts as an acid doping agent that stabilizes the charge transport materials, thereby substantially eliminating cycle-up. More in particular, addition of a polymer containing carboxylic acid groups or groups capable of forming carboxylic acid groups can result in the photoreceptor showing improved sensitivity, lower dark decay, steeper photo-induced discharge curves (PIDCs), lower discharge residual and no residual cycle-up.

Preferably, a polymer containing carboxylic acid groups or groups capable of forming carboxylic acid groups is included in the composition in an amount of about 5% by weight, solids basis, or less, e.g., from about 0.05% to about 5% by weight. More preferably, the acidic copolymer is included in the composition in an amount of less than about 1% by weight, most preferably from about 0.1 to about 0.9% by weight.

The carboxylic acid groups or groups capable of forming carboxylic acid groups, attached to a polymer to form polymeric acid, are not particularly limited, but may preferably be selected from Meldrum's acid, carboxylic acid, sulfonic acid, carboxylic anhydride and tert-butyl esters.

An example of a polymer containing carboxylic acid groups is a copolymer of 4,4-bis[4-hydroxyphenyl]valeric acid/bisphenol A polycarbonate (with a ratio of 0.25% by mole of carboxylic acid to 99.75% polycarbonate moities) (copolymer 1):

Copolymer 1

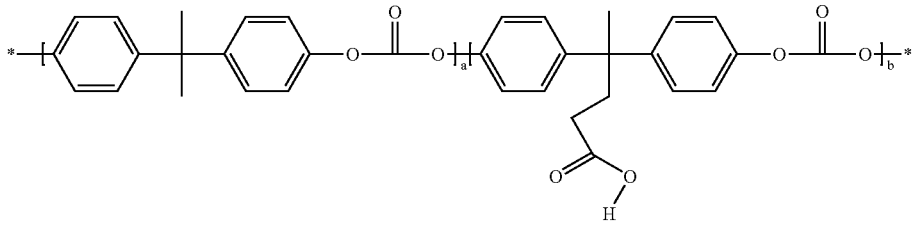

wherein a=0.9975 and b=0.0025 by mole fraction.

A suitable commercially available acidic copolymer is a vinyl chloride copolymer is UCARMAG 527®, comprising a polymeric reaction product of about 81 weight percent vinyl chloride, about 4 weight percent vinyl acetate, about 15 weight percent hydroxyethyl acrylate, and about 0.28 weight percent maleic acid and having a weight average molecular weight of about 35,000. See also U.S. Pat. No. 5,681,678, incorporated herein by reference.

UCARMAG 527® is believed to have the following structure:

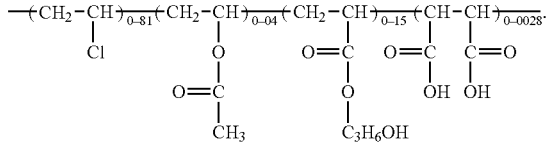

The charge transport layer composition may optionally also include an antioxidant that further assists in prevention of lateral charge migration. While antioxidants such as IRGANOX™ have been known to be added to charge transport layers for prevention of LCM, the optional antioxidant in the present composition is a hindered phenol antioxidant. Of course, it should be emphasized that as the hindered phenol antioxidant has a tendency to raise the background voltage and to shorten the photoreceptor life, and as the charge transport material DBA already provides the device sufficient LCM resistance, the presence of the hindered phenol antioxidant may not be necessary.

When included, the hindered phenol antioxidant preferably has the formula:

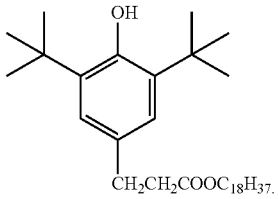

A suitable hindered phenol antioxidant having the foregoing formula is commercially available as CYANOX™ 2176 (Ciba Specialty Chemicals). If added, the hindered phenol antioxidant is present in an amount of less than about 5% by weight of the composition, preferably about 2.5% by weight or less, e.g., from about 0.1 to about 2.5% or 5% by weight.

The inclusion of the hindered phenol antioxidant can provide extra protection against LCM, and can also enable the device to have lower residual voltage after being discharged.

The charge transport layer composition is preferably made to include a solvent. In the present invention, the solvent used is preferably exclusively methylene chloride, although other solvents may be used without restriction, such as tetrahydrofuran (THF), toluene and the like.

The charge transport layer composition may also include additional additives used for their known conventional functions as recognized by practitioners in the art. Such additives may include, for example, leveling agents, surfactants, wear resistant additives such as polytetrafluoroethylene (PTFE) particles, light shock resisting or reducing agents, and the like.

The total solids to total solvents of the coating material may preferably be around about 10:90% by weight to about 30:70% by weight, more preferably between about 5:85% by weight to about 25:75% by weight.

To form the charge transport layer composition of the present invention, the components of the composition of the material are added to a vessel, for example a vessel equipped with a stirrer. The components may be added to the vessel in any order without restriction. Once all of the components of the charge transport layer composition have been added to the vessel, the solution may be mixed to form a uniform coating composition.

The charge transport layer solution is applied to the photoreceptor structure (which is detailed below). More in particular, the layer is formed upon a previously formed layer of the photoreceptor structure. Most preferably, the charge transport layer may be formed upon a charge generating layer. Any suitable and conventional technique may be utilized to apply the charge transport layer coating solution to the photoreceptor structure. Typical application techniques include, for example, spraying, dip coating, extrusion coating, roll coating, wire wound rod coating, draw bar coating and the like.

The other layers of the photoreceptor will next be explained. It should be emphasized that it is contemplated that the invention covers any photoreceptor structure, regardless of additional layers present and regardless of the ordering of the layers within the structure, so long as the charge transport layer includes the copolymer polycarbonate of the invention as described above. The photoreceptor may have any form, for example drum, belt, etc.

Any suitable multilayer photoreceptor may be employed in the imaging member of this invention. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. Most preferably, however, the charge transport layer is employed upon a charge generating layer, and the charge transport layer may optionally be overcoated with an overcoat and/or protective layer.

A photoreceptor of the invention employing the charge transport layer may comprise an optional anti-curl layer, a substrate, an optional hole blocking layer, an optional adhesive layer, a charge generating layer, the charge transport layer, and one or more optional overcoat and/or protective layer(s).

The photoreceptor substrate may comprise any suitable organic or inorganic material known in the art. The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. Similarly, the substrate can be either rigid or flexible. In a particularly preferred embodiment, the thickness of this layer is from about 3 mils to about 10 mils. For flexible belt imaging members, preferred substrate thicknesses are from about 65 to about 150 microns, and more preferably from about 75 to about 100 microns for optimum flexibility and minimum stretch when cycled around small diameter rollers of, for example, 19 millimeter diameter.

The substrate can be opaque or substantially transparent and can comprise numerous suitable materials having the desired mechanical properties. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The conductive layer can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and preferably from about 100 to about 200 Angstroms for an optimum combination of electrical conductivity, flexibility, and light transmission. When the selected substrate comprises a nonconductive base and an electrically conductive layer coated thereon, the substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as MYLAR™ (E. I. duPont de Nemours & Co.), MELINEX™ (duPont-Teijin Film), KALEDEX™ 2000 (ICI Americas Inc.), TEONEX™ (ICI Americas Inc.), or HOSTAPHAN™ (American Hoechst Corporation) and the like. The conductive layer can be coated onto the base layer by any suitable coating technique, such as vacuum deposition or the like. If desired, the substrate can comprise a metallized plastic, such as titanized or aluminized MYLAR, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate may comprise a metal oxide such as aluminum oxide, nickel oxide, titanium oxide, or the like.

Most preferably, the photoreceptor of the invention employing the charge transport layer is in the form of a belt or a drum. If a drum, the drum is most preferably in the form of a small diameter drum of the type used in copiers and printers.

A hole blocking layer may then optionally be applied to the substrate. Generally, electron blocking layers for positively charged photoreceptors allow the photogenerated holes in the charge generating layer at the top of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material. Typical hole blocking layers utilized for the negatively charged photoreceptors may include, for example, polyamides such as LUCKAMIDE (a nylon-6 type material derived from methoxymethyl-substituted polyamide), hydroxy alkyl methacrylates, nylons, gelatin, hydroxyl alkyl cellulose, organopolyphosphazenes, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An especially preferred blocking layer comprises a reaction product between a hydrolyzed silane and the zirconium and/or titanium oxide layer which inherently forms on the surface of the metal layer when exposed to air after deposition. This combination reduces spots and provides electrical stability at low RH. The imaging member is prepared by depositing on the zirconium and/or titanium oxide layer of a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450, the disclosure thereof being incorporated herein in its entirety. After drying, the siloxane reaction product film formed from the hydrolyzed silane contains larger molecules. The reaction product of the hydrolyzed silane may be linear, partially crosslinked, a dimer, a trimer, and the like.

The siloxane blocking layer should be continuous and have a thickness of less than about 0.5 micrometer because greater thicknesses may lead to undesirably high residual voltage. A blocking layer of between about 0.005 micrometer and about 0.3 micrometer (50 Angstroms to 3,000 Angstroms) is preferred because charge neutralization after the exposure step is facilitated and optimum electrical performance is achieved.

An adhesive layer may optionally be applied to the hole blocking layer. The adhesive layer may comprise any suitable film forming polymer. Typical adhesive layer materials include, for example, copolyester resins, polyarylates, polyurethanes, blends of resins, and like.

A preferred copolyester resin is a linear saturated copolyester reaction product of four diacids and ethylene glycol. The molecular structure of this linear saturated copolyester in which the mole ratio of diacid to ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4: 1:1. A representative linear saturated copolyester adhesion promoter of this structure is commercially available as 49,000 (available from Rohm and Haas Inc., previously available from Morton International Inc.). Another preferred representative polyester resin is a copolyester resin derived from a diacid selected from the group consisting of terephthalic acid, isophthalic acid, and mixtures thereof and diol selected from the group consisting of ethylene glycol, 2,2-dimethyl propanediol and mixtures thereof; the ratio of diacid to diol being 1:1. Typical polyester resins are commercially available and include, for example, VITEL polyesters.

The diacids from which the polyester resins of this invention are derived are terephthalic acid, isophthalic acid, adipic acid and/or azelaic acid acids only. Any suitable diol may be used to synthesize the polyester resins employed in the adhesive layer of this invention. Typical diols include, for example, ethylene glycol, 2,2-dimethyl propane diol, butane diol, pentane diol, hexane diol, and the like.

Alternatively, the adhesive interface layer may comprise polyarylate (ARDEL D-100, available from Toyota Hsutsu Inc.), polyurethane or a polymer blend of these polymers with a carbazole polymer. Adhesive layers are well known and described, for example in U.S. Pat. Nos. 5,571,649, 5,591,554, 5,576,130, 5,571,648, 5,571,647 and 5,643,702, the entire disclosures of these patents being incorporated herein by reference.

Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer is applied directly to the charge blocking layer. Thus, the adhesive layer of this invention is in direct contiguous contact with both the underlying charge blocking layer and the overlying charge generating layer to enhance adhesion bonding and to effect ground plane hole injection suppression. Drying of the deposited coating may be effected by any suitable conventional process such as oven drying, infra red radiation drying, air drying and the like. The adhesive layer should be continuous. Satisfactory results are achieved when the adhesive layer has a thickness between about 0.01 micrometer and about 2 micrometers after drying. Preferably, the dried thickness is between about 0.03 micrometer and about 1 micrometer.

The photogenerating layer may comprise single or multiple layers comprising inorganic or organic compositions and the like. One example of a generator layer is described in U.S. Pat. No. 3,121,006, the disclosure of which is totally incorporated herein by reference, wherein finely divided particles of a photoconductive inorganic compound are dispersed in an electrically insulating organic resin binder. Multiphotogenerating layer compositions may be utilized where a photoconductive layer enhances or reduces the properties of the photogenerating layer.

The charge generating layer of the photoreceptor may comprise any suitable photoconductive particle dispersed in a film forming binder. Typical photoconductive particles include, for example, phthalocyanines such as metal free phthalocyanine, copper phthalocyanine, titanyl phthalocyanine, hydroxygallium phthalocyanine, vanadyl phthalocyanine and the like, perylenes such as benzimidazole perylene, trigonal selenium, quinacridones, substituted 2,4-diaminotriazines, polynuclear aromatic quinones, and the like. Especially preferred photoconductive particles include hydroxygallium phthalocyanine, chlorogallium phthalocyanine, benzimidazole perylene and trigonal selenium.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in about 40 percent by volume to about 90 percent by volume of the film forming polymer binder composition, and preferably from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

The photogenerating layer containing photoconductive compositions and the resinous binder material generally ranges in thickness from about 0.05 micron to about 10 microns or more, preferably being from about 0.1 micron to about 5 microns, and more preferably having a thickness of from about 0.3 micron to about 3 microns, although the thickness can be outside these ranges. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infra red radiation drying, air drying and the like.

Any suitable solvent may be utilized to dissolve the film forming binder. Typical solvents include, for example, tetrahydrofuran, toluene, methylene chloride, monochlorobenzene and the like. Coating dispersions for charge generating layer may be formed by any suitable technique using, for example, attritors, ball mills, Dynomills, paint shakers, homogenizers, microfluidizers, and the like.

Furthermore, in embodiments, the electrophotographic imaging member may also contain a plurality, e.g., two, charge transport layers comprising a first (bottom) charge transport layer which is in contiguous contact with the photogenerating layer and a second (top) charge transport layer coated over the first charge transport layer.

Optionally, an overcoat layer and/or a protective layer can also be utilized to improve resistance of the photoreceptor to abrasion. In some cases, an anti-curl back coating may be applied to the surface of the substrate opposite to that bearing the photoconductive layer to provide flatness and/or abrasion resistance where a web configuration photoreceptor is fabricated. These overcoating and anti-curl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anti-curl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semi-conductive matrices. The use of such an overcoat can still further increase the wear life of the photoreceptor, the overcoat having a wear rate of 2 to 4 microns per 100 kilocycles, or wear lives of between 150 and 300 kilocycles.

The photoreceptor of the invention is utilized in an electrophotographic image forming device for use in an electrophotographic imaging process. As explained above, such image formation involves first uniformly electrostatically charging the photoreceptor, then exposing the charged photoreceptor to a pattern of activating electromagnetic radiation such as light, which selectively dissipates the charge in the illuminated areas of the photoreceptor while leaving behind an electrostatic latent image in the non-illuminated areas. This electrostatic latent image may then be developed at one or more developing stations to form a visible image by depositing finely divided electroscopic toner particles, for example from a developer composition, on the surface of the photoreceptor. The resulting visible toner image can be transferred to a suitable receiving member such as paper. The photoreceptor is then typically cleaned at a cleaning station prior to being re-charged for formation of subsequent images.

The photoreceptor of the present invention may be charged using any conventional charging apparatus. Such may include, for example, an AC bias charging roll (BCR) as known in the art. See, for example, U.S. Pat. No. 5,613,173, incorporated herein by reference in its entirety. Charging may also be effected by other well known methods in the art if desired, for example utilizing a corotron, dicorotron, scorotron, pin charging device, and the like.

The invention will now be further described by the following examples and comparative examples, which are intended to further illustrate the invention but not necessarily limit the invention. All parts and percentages are by weight unless otherwise indicated.

EXAMPLE 1

An imaging member was prepared by providing a 0.02 micrometer thick titanium layer coated on a biaxially oriented polyethylene naphthalate substrate (KALEDEX™ 2000) having a thickness of 3.5 mils, and applying thereon, with a gravure applicator, a solution containing 50 grams 3-amino-propyltriethoxysilane, 41.2 grams water, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 500 Angstroms.

An adhesive layer was then prepared by applying a wet coating over the blocking layer, using a gravure applicator, containing 0.2 percent by weight based on the total weight of the solution of copolyester adhesive (ARDEL D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion is prepared by introducing 0.45 grams of LUPILON® 200® (PCZ 200) available from Mitsubishi Gas Chemical Corp. and 50 ml of tetrahydrofuran into a 4 oz. glass bottle. To this solution are added 2.4 grams of hydroxygallium phthalocyanine (OHGaPc) and 300 grams of ⅛ inch (3.2 millimeter) diameter stainless steel shot. This mixture is then placed on a ball mill for 20 to 24 hours. Subsequently, 2.25 grams of PCZ 200 is dissolved in 46.1 gm of tetrahydrofuran, and added to this OHGaPc slurry. This slurry is then placed on a shaker for 10 minutes. The resulting slurry was, thereafter, applied to the adhesive interface with a Bird applicator to form a charge generation layer having a wet thickness of 0.25 mil. However, a strip about 10 mm wide along one edge of the substrate web bearing the blocking layer and the adhesive layer was deliberately left uncoated by any of the photogenerating layer material to facilitate adequate electrical contact by the ground strip layer that was applied later. The charge generation layer was dried at 135° C. for 5 minutes in a forced air oven to form a dry charge generation layer having a thickness of 0.4 micrometer.

EXAMPLE 2 (COMPARATIVE)

A photogenerator layer of Example 1 was coated with a transport layer (HTM) containing 50 weight percent (based on the total solids) of an impure hole transport compound primarily consisting of N,N'-diphenyl-N,N'-bis(3-methylphenyl)-(1,1'-biphenyl)-4,4'-diamine.

In a one ounce brown bottle, 1.2 grams MAKROLON (PC-A from Bayer AG) was placed into 13.5 grams of methylene chloride and stirred with a magnetic bar. After the polymer was completely dissolved, 1.2 grams of impure N,N'-diphenyl-N,N'-bis(3-methylphenyl)-1,1'-biphenyl-4,4'-diamine was added. The mixture was stirred overnight to assure a complete solution. The solution was applied onto the photogenerator layer made in Example 1 using a 4 mil Bird bar to form a coating. The coated device was then heated in a forced hot air oven where the air temperature was elevated from about 40° C. to about 100° C. over a 30 minute period to form a charge transport layer having a dry thickness of 29 micrometers.

EXAMPLE 3

Following the same procedure in Example 2, a charge transport layer with a thickness of 29 micrometers was formed on the substrate of Example 1, using a solution of 1.2 grams of MAKROLON (PC-A from Bayer AG), 1.2 grams of N,N'-diphenyl-N,N'-bis(3-methylphenyl)-1,1'-biphenyl-4,4'-diamine and 0.0018 grams of UCARMAG® 527 in 13.5 grams of methylene chloride.

EXAMPLE 4 (COMPARATIVE)

Following the same procedure in Example 2, a charge transport layer with a thickness of 29 micrometers was formed on the substrate of Example 1, using a solution of 2.2 grams of MAKROLON (PC-A from Bayer AG) and 1.8 grams of N,N'-di-(3,4-dimethylphenyl)-N-(4-biphenyl) amine in 20 grams of methylene chloride.

EXAMPLE 5

Following the same procedure in Example 2, a charge transport layer with a thickness of 29 micrometers was formed on the substrate of Example 1, using a solution of 2.16 grams of MAKROLON (PC-A from Bayer AG), 1.8 grams of N,N-di(3,4-dimethylphenyl)-N-(4-biphenyl)amine and 0.04 gram of UCARMAG® 527 in 20 grams of methylene chloride.

EXAMPLE 6 (COMPARATIVE)

Following the same procedure in Example 2, a charge transport layer with a thickness of 29 micrometers was formed on the substrate of Example 1, using a solution of 2.0 grams of polycarbonate PCZ-400 (from Mitsubushi Chemicals Co.) and 2.0 grams of N,N'-diphenyl-N,N'-bis(3-hydroxyphenyl)-1,1'-biphenyl-4,4'-diamine in 16.5 grams of tetrahydrofuran.

EXAMPLE 7

Following the same procedure in Example 2, a charge transport layer with a thickness of 29 micrometers was formed on the substrate of Example 1, using a solution of 2.0 grams of polycarbonate PCZ-400 (from Mitsubushi Chemicals Co.), 1.8 grams of N,N'-diphenyl-N,N'-bis(3-hydroxyphenyl)-1,1'-biphenyl-4,4'-diamine and 0.2 gram of UCARMAG® 527 in 16.5 grams of tetrahydrofuran.

EXAMPLE 8

On the substrate of Example 1, a 29 micron thick charge transport layer was formed by the same procedure in Example 2. The coating solution contained 1.2 grams of N,N-di(3,4-dimethylphenyl)-N-(4-biphenyl)amine, 1.2 grams of N,N-di(3,4-dimethylphenyl)-N-(4-biphenyl) amine, 2.4 grams of MAKROLON (PC-A from Bayer AG), 0.608 gram of CYANOX 2176® (Ciba Specialty Chemicals) and 0.15 gram of a copolymer of 4,4-bis[4-hydroxyphenyl] valeric acid/bisphenol A polycarbonate (with a ratio of 0.25% by mole of carboxylic acid to 99.25% polycarbonate moities) in 24 grams methylene chloride.

EXAMPLE 9

On the substrate of Example 1, a 29 micron thick charge transport layer was formed by the same procedure in Example 2. The coating solution contained 1.2 grams of N,N-di(3,4-dimethylphenyl)-N-(4-biphenyl)amine, 1.2 grams of N,N-di(3,4-dimethylphenyl)-N-(4-biphenyl) amine, 2.4 grams of MAKROLON (PC-A from Bayer AG), 0.608 gram of CYANOX 2176® (Ciba Specialty Chemicals) and 0.25 grams of a copolymer of 4,4-bis[4-hydroxyphenyl] valeric acid/bisphenol A polycarbonate (with a ratio of 0.25% by mole of carboxylic acid to 99.25% polycarbonate moities) in 24 grams methylene chloride.

Each formulation is summarized in Table 1.

TABLE 1

| Sample | Charge Transport Material | Binder | Polymeric Acid | Solvent |
|---|---|---|---|---|
| Comparative Example 2 | TPD | PC-A | 0 | MeCl2 |
| Example 3 | TPD | PC-A | 0.08% Ucar 527 | MeCl2 |

TABLE 1-continued

| Sample | Charge Transport Material | Binder | Polymeric Acid | Solvent |
|---|---|---|---|---|
| Comparative Example 4 | DBA | PC-A | 0 | MeCl2 |
| Example 5 | DBA | PC-A | 1% Ucar 527 | MeCl2 |
| Comparative Example 6 | DHTPD | PCZ | 0 | THF |
| Example 7 | DHTPD | PCZ | 5% Ucar 527 | THF |
| Example 8 | DBA/TPD 1/1 | PC-A | 3% Copolymer 1 | MeCl2 |
| Example 9 | DBA/TPD 1/1 | PC-A | 5% Copolymer 1 | MeCl2 |

Each of the above solutions are coated onto a charge generating layer, comprised of hydroxygallium phthalocyanine in a PCZ polycarbonate binder, to form a 30 micrometer thick charge transport layer. The photoreceptor was then dried at 110° C. for 30 minutes.

Each photoreceptor device of Examples 2 to 9 was mounted on a cylindrical aluminum drum which is rotated on a shaft. The films were charged by a corotron mounted along the circumference of the drum. The surface potentials were measured as a function of time by several capacitively coupled electrostatic voltmeters placed at different locations around the shaft. The films on the drum were exposed and erased by light sources located at appropriate positions around the drum. The measurements were accomplished charging the photoconductor devices in a constant current or voltage mode. As the drum rotated, the initial charging potential was measured. Further rotation leads to the exposure station, where the photoconductor devices were exposed to monochromatic radiation of known intensity. The surface potential after exposure was also measured. The devices were then exposed to an erase lamp of appropriate intensity and any residual potentials are measured. A photo induced discharge curve (PIDC) was obtained by plotting the potentials as a function of exposure which is governed by an electric field dependent quantum efficiency. The Example photoreceptors were found to have lower residual voltage as compared to the curves for the corresponding Comparative Example. Such indicates that the addition of the acid component can reduce the residual voltage in PIDC. Further, in performance of a 10,000 cycling test, the inclusion of the acid component can also help stabilize the cycling performance of the photoreceptor. The data for electrical properties are listed in the following Table 2

TABLE 2

| Sample | V0, volts | Initial Vr, volts | ΔVr in 10K cycles, volts |
|---|---|---|---|
| Comparative Example 2 | 798 | 48 | 16 |
| Example 3 | 797 | 30 | −9 |
| Comparative Example 4 | 797 | 94 | 26 |
| Example 5 | 799 | 31 | −19 |
| Comparative Example 6 | 796 | 237 | 144 |
| Example 7 | 791 | 149 | −34 |
| Example 8 | 797 | 44 | −16 |
| Example 9 | 797 | 46 | −12 |

In the Table, V0 is the initial voltage charged on the photoreceptor device, Vr is the remaining, residual voltage after the photo-induced full discharge and ΔVr is the residual voltage change after 10,000 charging-discharging cycles.

While the invention has been described in conjunction with exemplary embodiments, these embodiments should be viewed as illustrative, not limiting. Various modifications, substitutes, or the like are possible within the spirit and scope of the invention.

What is claimed is:

1. A charge transport layer composition for a photoreceptor, comprising at least a binder, at least one arylamine charge transport material, and a polymer containing carboxylic acid groups or groups capable of forming carboxylic acid groups, wherein the polymer containing carboxylic acid groups or groups capable of forming carboxylic acid groups is present in an amount of from about 0.05% by weight to about 5% by weight of the composition.

2. A charge transport layer composition according to claim 1, wherein the arylamine charge transport material includes an aryl diamine of formula:

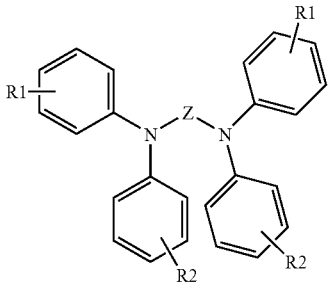

where R1 and R2 are selected independently from methyl, ethyl, propyl and aryl; Z is selected from the group consisting of

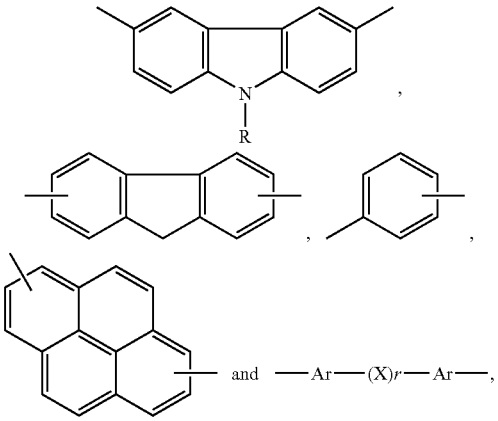

r is 0 or 1; Ar is selected from the group consisting of:

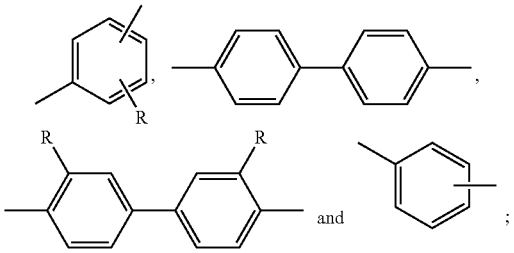

R is selected from the group consisting of methyl, ethyl, propyl and butyl; and

X is selected from the group consisting of:

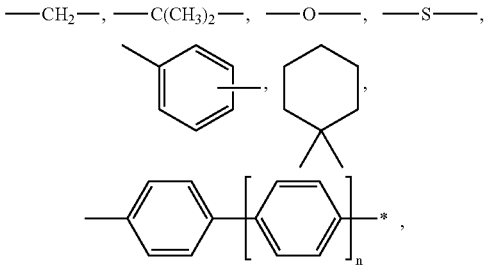

n being any suitable integer.

3. A charge transport layer composition according to claim 2, wherein the aryl diamine is selected from the group consisting of N,N'-diphenyl-N,N'-bis(alkylphenyl)-[1,1'-biphenyl]-4,4'-diamine wherein the alkyl is methyl, ethyl, propyl or n-butyl, N,N'-diphenyl-N,N'-bis(3-methylphenyl)-[1,1'-biphenyl]-4,4'-diamine, N,N'-diphenyl-N,N'-bis(3-hydroxyphenyl)-(1,1'-biphenyl)-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and mixtures thereof.

4. A charge transport layer composition according to claim 1, wherein the arylamine charge transport material includes an aryl monoamine of formula:

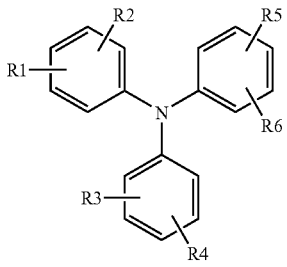

where R1, R2, R3, R4, R5 and R6 are selected independently from aryl, H, methyl, ethyl, propyl and butyl groups.

5. A charge transport layer composition according to claim 4, wherein the aryl monoamine is selected from the group consisting of bis-(4-methylphenyl)-4-biphenylylamine, bis(4-methoxyphenyl)-4-biphenylylamine, bis-(3-methylphenyl)-4-biphenylylamine, bis(3-methoxyphenyl)-4-biphenylylamine-N-phenyl-N-(4-biphenylyl)-p-toluidine, N-phenyl-N-(4-biphenylyl)-p-toluidine, N-phenyl-N-(4-biphenylyl)-m-anisidine, bis(3-phenyl)-4-biphenylylamine, N,N,N-tri[3-methylphenyl]amine, N,N,N-tri[4-methylphenyl]amine, N,N-di-(3-methylphenyl)-p-toluidine, N,N-di(4-methylphenyl)-m-toluidine, bis-N,N-[(4'-methyl-4-(1,1'-biphenyl)]-aniline, bis-N,N-[(2'-methyl-4(1,1'-biphenyl)]-aniline, bis-N,N-[(2'-methyl-4(1,1'-biphenyl)]-p-toluidine, bis-N,N-[(2'-methyl-4(1,1'-biphenyl)]-m-toluidine, N,N-di-(3,4-dimethylphenyl)-4-biphenylamine, and mixtures thereof.

6. A charge transport layer composition according to claim 1, wherein the charge transport material comprises both an aryl diamine and an aryl monoamine in a weight ratio of aryl diamine to aryl monoamine of from about 10:90 to about 90:10.

7. A charge transport layer composition according to claim 1, wherein the charge transport layer composition further comprises a hindered phenol antioxidant.

8. A charge transport layer composition according to claim 7, wherein the hindered phenol antioxidant has the structure

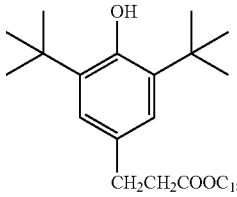

9. A charge transport layer composition according to claim 1, wherein the carboxylic acid groups or groups capable of forming carboxylic acid groups, attached to a polymer to form polymeric acid, are selected from Meldrum's acid, carboxylic acid, sulfonic acid, carboxylic anhydride and tert-butyl esters.

10. A charge transport layer composition according to claim 1, wherein the binder is a polycarbonate binder.

11. A charge transport layer composition according to claim 10, wherein the polycarbonate binder is a biphenyl A polycarbonate or a bisphenol Z polycarbonate.

12. An image forming device according to claim 11, wherein the charge transport layer further comprises a hindered phenol antioxidant.

13. A charge transport layer composition according to claim 1, wherein the charge transport layer composition further comprises methylene chloride solvent.

14. An image forming device comprising at least a photoreceptor and a charging device that charges the photoreceptor, wherein the photoreceptor comprises an optional anti-curl layer, a substrate, an optional hole blocking layer, an optional adhesive layer, a charge generating layer, a charge transport layer comprising at least a binder, at least one arylamine charge transport material, and a polymer containing carboxylic acid groups or groups capable of forming carboxylic acid groups, wherein the polymer containing carboxylic acid groups or groups capable of forming carboxylic acid groups is present in an amount of from about 0.05% by weight to about 5% by weight of the composition, and optionally one or more overcoat or protective layers.

15. An image forming device according to claim 14, wherein the arylamine charge transport material is selected from the group consisting of aryl diamines, aryl monoamines and mixtures thereof.

16. An image forming device according to claim 15, wherein the arylamine charge transport material includes an aryl monoamine of formula:

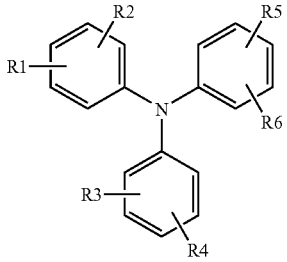

where R1, R2, R3, R4, R5 and R6 are selected independently from aryl, H, methyl, ethyl, propyl and butyl groups.

17. An image forming device according to claim 16, wherein the aryl monoamine is selected from the group consisting of bis-(4-methylphenyl)-4-biphenylylamine, bis(4-methoxyphenyl)-4-biphenylylamine, bis-(3-methylphenyl)-4-biphenylylamine, bis(3methoxyphenyl)-4-biphenylylamine-N-phenyl-N-(4-biphenylyl)-p-toluidine, N-phenyl-N-(4-biphenylyl)-p-toluidine, N-phenyl-N-(4-biphenylyl)-m-anisidine, bis(3-phenyl)-4-biphenylylamine, N,N,N-tri[3-methylphenyl]amine, N,N,N-tri[4-methylphenyl]amine, N,N-di(3-methylphenyl)-p-toluidine, N,N-di(4-methylphenyl)-m-toluidine, bis-N,N-[(4'-methyl-4-(1,1'-biphenyl)]-aniline, bis-N,N-[(2'-methyl-4(1,1'-biphenyl)]-aniline, bis-N,N-[(2'-methyl-4(1,1'-biphenyl)]-p-toluidine, bis-N,N-[(2'-methyl-4(1,1'-biphenyl)]-m-toluidine, N,N-di-(3,4-dimethylphenyl)-4-biphenylamine, and mixtures thereof.

18. An image forming device according to claim 15, wherein the arylamine charge transport material includes an aryl diamine of formula:

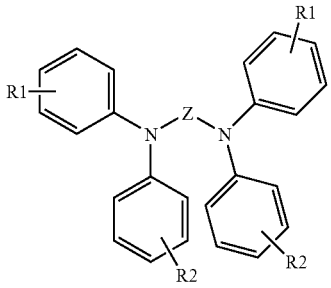

where R1 and R2 are selected independently from methyl, ethyl, propyl and aryl; Z is selected from the group consisting of

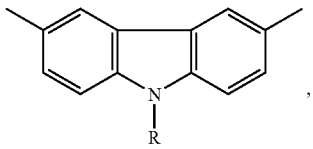

,

-continued

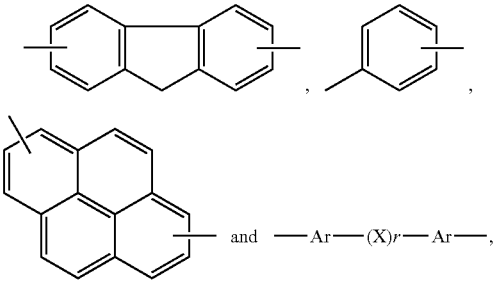

and —Ar—(X)$_r$—Ar—, r is 0 or 1; Ar is selected from the group consisting of:

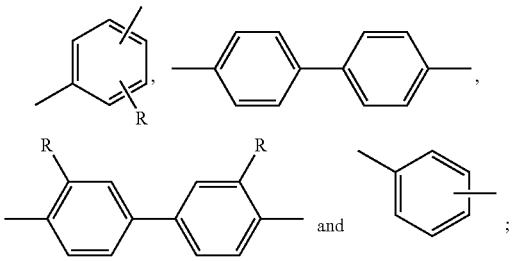

R is selected from the group consisting of methyl, ethyl, propyl and butyl; and

X is selected from the group consisting of:

—$CH_2$—, —$C(CH_3)_2$—, —O—, —S—,

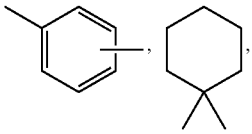

-continued

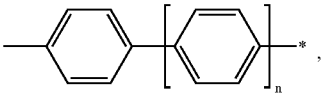

n being any suitable integer.

19. An image forming device according to claim 18, wherein the aryl diamine is selected from the group consisting of N,N'-diphenyl-N,N'-bis(alkylphenyl)-[1,1'-biphenyl]-4,4'-diamine wherein the alkyl is methyl, ethyl, propyl or n-butyl, N,N'-diphenyl-N,N'-bis(3-methylphenyl)-[1,1'-biphenyl]-4,4'-diamine, N,N'-diphenyl-N,N'-bis(3-hydroxyphenyl)-(1,1'-biphenyl)-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and mixtures thereof.

20. An electrophotographic device, comprising the image forming device of claim 14.

* * * * *